US008905870B1

(12) United States Patent
Stafford

(10) Patent No.: US 8,905,870 B1
(45) Date of Patent: Dec. 9, 2014

(54) BASEBALL STRIKE ZONE TRAINING AID

(71) Applicant: Harry L. Stafford, Clermont, FL (US)

(72) Inventor: Harry L. Stafford, Clermont, FL (US)

( * ) Notice: Subject to any disclaimer, the term of this patent is extended or adjusted under 35 U.S.C. 154(b) by 77 days.

(21) Appl. No.: 13/714,982

(22) Filed: Dec. 14, 2012

(51) Int. Cl.
*A63B 69/00* (2006.01)

(52) U.S. Cl.
CPC ..... *A63B 69/0002* (2013.01)
USPC ..... 473/454

(58) Field of Classification Search
USPC ..... 273/398–402, 395, 396; 473/454, 473/376–378, 197, 434, 435
See application file for complete search history.

(56) References Cited

U.S. PATENT DOCUMENTS

| | | | | | |
|---|---|---|---|---|---|
| 2,059,365 | A | | 11/1936 | King | |
| 2,126,102 | A | * | 8/1938 | Fowler | 473/456 |
| 3,312,467 | A | | 4/1967 | Dawson | |
| 3,583,703 | A | * | 6/1971 | Brown et al. | 473/456 |
| 3,997,158 | A | * | 12/1976 | Britton | 473/454 |
| 4,210,326 | A | * | 7/1980 | Booth et al. | 473/454 |
| 4,473,227 | A | * | 9/1984 | Klaus | 473/454 |
| 4,629,188 | A | * | 12/1986 | Mahieu | 473/454 |
| 4,768,784 | A | | 9/1988 | Wilson | |
| 5,083,774 | A | * | 1/1992 | Yalvac | 473/456 |
| D350,569 | S | | 9/1994 | Boteler | |
| 5,348,291 | A | * | 9/1994 | Scully | 473/454 |
| 5,433,434 | A | | 7/1995 | Helmetsie | |
| 5,511,775 | A | * | 4/1996 | Parks | 473/454 |
| 5,524,882 | A | * | 6/1996 | Wagner | 473/477 |
| 5,704,855 | A | | 1/1998 | Kellogg, Jr. | |
| 5,803,841 | A | | 9/1998 | Daskoski | |
| 6,663,513 | B2 | | 12/2003 | Howard | |
| 6,776,417 | B1 | * | 8/2004 | Holgate | 273/400 |
| 7,163,474 | B1 | * | 1/2007 | Skinner et al. | 473/454 |
| 8,096,903 | B1 | * | 1/2012 | Brown, II | 473/478 |
| 8,540,593 | B1 | * | 9/2013 | Marnane | 473/454 |
| 2004/0014538 | A1 | * | 1/2004 | Bennett | 473/456 |
| 2012/0010028 | A1 | * | 1/2012 | Hammons | 473/454 |
| 2012/0052989 | A1 | * | 3/2012 | Bishop | 473/456 |

* cited by examiner

*Primary Examiner* — Mark Graham
(74) *Attorney, Agent, or Firm* — Robert C. Montgomery; Montogomery Patent & Design

(57) ABSTRACT

A portable baseball practice device for training hitting and pitching which comprises a pair of opposing upright posts that support a centrally located strike zone that is formed by interconnecting horizontal and vertical cords. The cords create a strike zone for the pitcher to target to and the hitter to practice hitting.

18 Claims, 7 Drawing Sheets

BASEBALL STRIKE ZONE TRAINING AID

RELATED APPLICATIONS

There are no current co-pending applications.

FIELD OF THE INVENTION

The presently disclosed subject matter is directed to athletic training aids. More particularly, the present invention relates to a portable practice device for training baseball hitting and pitching.

BACKGROUND OF THE INVENTION

Three (3) of the most difficult skills to learn in baseball are pitching a baseball into the strike zone, determining if a pitched ball is in the strike zone, and hitting a pitched ball passing through the strike zone. The required skills include pitch control, the ability to carefully observe a pitched ball, and the ability to recognize hittable balls, and then to hit those balls.

The foregoing skills are not easily learned. Pitchers need to develop enhanced ball control while batters need to develop the ability to both track a pitched ball and to hit it in front of the plate. Because of the difficulty, coaches spend a great deal of time and effort teaching these required skills. It is not always easy for a coach to determine how each of his players is developing. Calling strikes is time-consuming and if you do not have a pitcher that can reliably throw strikes it becomes difficult to teach batters how to determine when a pitched ball is in the strike zone.

Given the forgoing, a device for helping teach a baseball pitcher to throw a ball into the strike zone would be beneficial. Even more beneficial would be a device that not only teaches a pitcher to throw a baseball into the strike zone, but one (1) that assists a batter to know when a baseball is coming into the strike zone. Still more beneficial would be a device that teaches a pitcher to throw a baseball into the strike zone, assists a batter to know when a baseball is coming into the strike zone, and one (1) that helps teach a batter to hit a ball coming into the strike zone. Preferably such a device would be available in a portable version. Beneficially such a device would be customizable for different batters and pitchers. Also beneficially such a device would be available in a permanently mounted version.

SUMMARY OF THE INVENTION

The principles of the present invention provide for a baseball strike zone training aid that helps teach a baseball pitcher to throw a ball into the strike zone. The present invention can be made available as a baseball training aid that not only teaches a pitcher to throw a baseball into the strike zone, but that assists a batter to know when a baseball is coming into the strike zone. In addition, the inventive baseball strike zone training aid can be used to teach a batter to hit a ball coming into the strike zone. Versions of the baseball training aid can be made available a being permanent, portable version, and/or customizable.

A baseball strike zone training aid that is in accord with the present invention includes a first post assembly having a first upper attachment feature and a first lower attachment feature, a second post assembly having a second upper attachment feature and a second lower attachment feature, an upper horizontal cord that is suspended between the first upper attachment feature and the second upper attachment feature, a lower horizontal cord that is suspended between the first lower attachment feature and the second lower attachment feature, a first vertical cord that is disposed between the upper horizontal cord and the lower horizontal cord; and a second vertical cord that is disposed between the upper horizontal cord and the lower horizontal cord. The upper horizontal cord, the lower horizontal cord, the first vertical cord, and the second vertical cord define a strike zone.

Beneficially the first post assembly includes a vertically orientated, elongated fastening angle member having a plurality of hook apertures. Also beneficially the first upper attachment includes a first tensioner that is operatively connected to an upper hook aperture and the first lower attachment includes a second tensioner that is operatively connected to a lower hook aperture. The first tensioner tensions the upper horizontal cord and the second tensioner tensions the lower horizontal cord. The height of the strike zone then depends on the upper hook aperture, the lower hook aperture, the tension applied by the first tensioner, and the tension applied by the second tensioner. Preferably the first tensioner is connected to the upper hook aperture by a first hook and by a split ring. In practice the baseball strike zone training aid may have the upper horizontal cord connected to the second post assembly by a clasp, a strap, and a second hook, while the first vertical cord may include a first loop around the upper horizontal cord and a second loop around the lower horizontal cord. Those loops can be secured by a crimped ferrule.

The baseball strike zone training aid may also include a first "H"-shaped foundation that is attached to the bottom of the first post assembly and a second "H"-shaped foundation that is attached to the bottom of the second post assembly. The first "H"-shaped foundation and the second "H"-shaped foundation are used to vertically support the baseball strike zone training aid. To that end the first "H"-shaped foundation can include a fill material such as sand. Alternatively the post assemblies can be configured to be buried directly into the ground or in concrete. A removable padded cover assembly may be included to protect the post assemblies.

An alternative baseball strike zone training aid includes a first post assembly having a first upper post, a wire attachment feature connected to the first upper post, a first lower post connected to the first upper post, and a first tripod base that is attached to the first lower post. In addition, the baseball strike zone training aid includes a second post assembly having a second upper post, a second lower post connected to the second upper post, and a second tripod base that is attached to the second lower post. An upper horizontal cord is suspended between the first post assembly and the second post assembly while a lower horizontal cord is also suspended between the first post assembly and the second post assembly. The alternative baseball strike zone training aid also includes a first vertical cord that is disposed between the upper horizontal cord and the lower horizontal cord, and a second vertical cord that is disposed between the upper horizontal cord and the lower horizontal cord. The upper horizontal cord, lower horizontal cord, first vertical cord, and second vertical cord define a strike zone.

In practice the first tripod base is beneficially collapsible and includes a stake aperture; the first lower post includes a height adjustment sleeve for attaching the first upper post to the first lower post and for adjusting the height of the first post assembly, and a guy wire. The guy wire is attached to the wire attachment feature and to a ground to vertically support the alternative baseball strike zone training aid.

The alternative baseball strike zone training aid may also include a vertically orientated and elongated fastening angle member having a plurality of hook apertures, the first upper attachment feature may include a first tensioner that is operatively connected to an upper hook aperture, and the first lower attachment feature may include a second tensioner operatively connected to a lower hook aperture. The height of the strike zone may then depend on the upper hook aperture, the lower hook aperture, the tension applied by the first tensioner, and the tension applied by the second tensioner.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
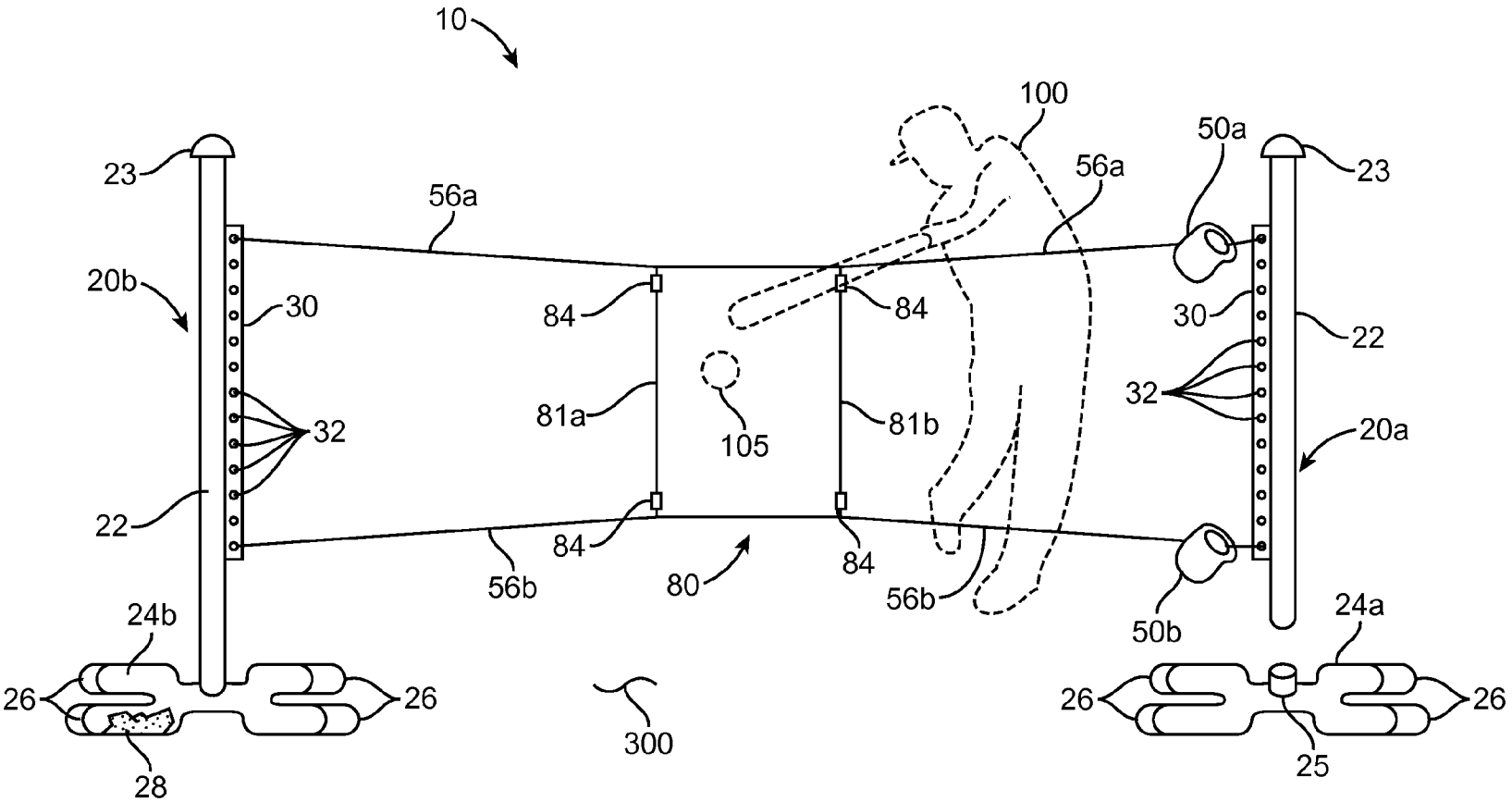
FIG. 1 is a front view depicting an in-use baseball strike zone training aid 10 that is in accord with the preferred embodiment of the present invention.

10 baseball strike zone training aid
20*a* first post assembly
20*b* second post assembly
22*a* first post
22*b* second post
23 first cap
24*a* first foundation
24*b* second foundation
25 receiver
26 cap
28 fill material
30 fastening angle member
32 hook aperture
50*a* first tensioner
50*b* second tensioner
52 body
54 handle
56*a* upper horizontal cord
56*b* lower horizontal cord
58 strap
60 clasp
62 cover assembly
63 jacket
64 padding
65 seam
66 hook-and-loop fastener
68 indicia
80 strike zone
81*a* first vertical cord
81*b* second vertical cord
82 loop
84 crimped ferrule
100 player
105 ball
120 personal embodiment strike zone training aid
125*a* first tripod post assembly
125*b* second tripod post assembly
127 second post
128 third post
129 third cap
130 height adjustment sleeve
132 tightening knob
140*a* first tripod base
140*b* second tripod base
142 stake
150 guy wire
160 permanent embodiment strike zone training aid
162*a* first permanent post assembly
162*b* second permanent post assembly
164 fourth cap
200 fastener
202 split ring
204*a* first hook
204*b* second hook
300 floor/ground surface
305 footer

DETAILED DESCRIPTION OF THE PREFERRED EMBODIMENT

Figure 4:
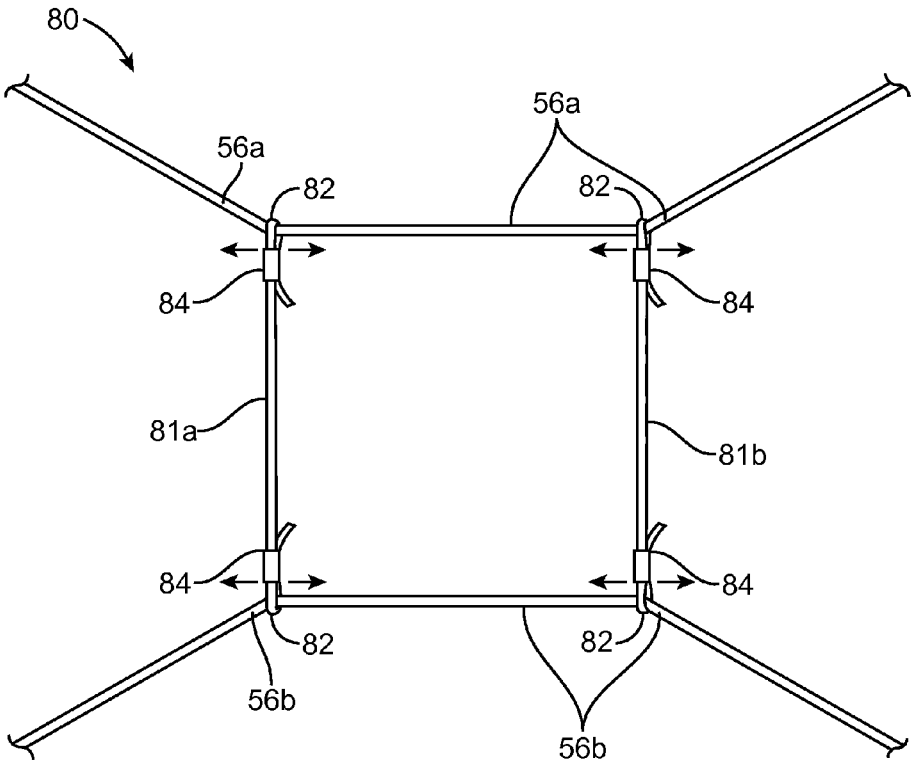
FIG. 4 is a close-up view of a strike zone 80 of the baseball strike zone training aid 10 shown in FIG. 1.
Figure 5:
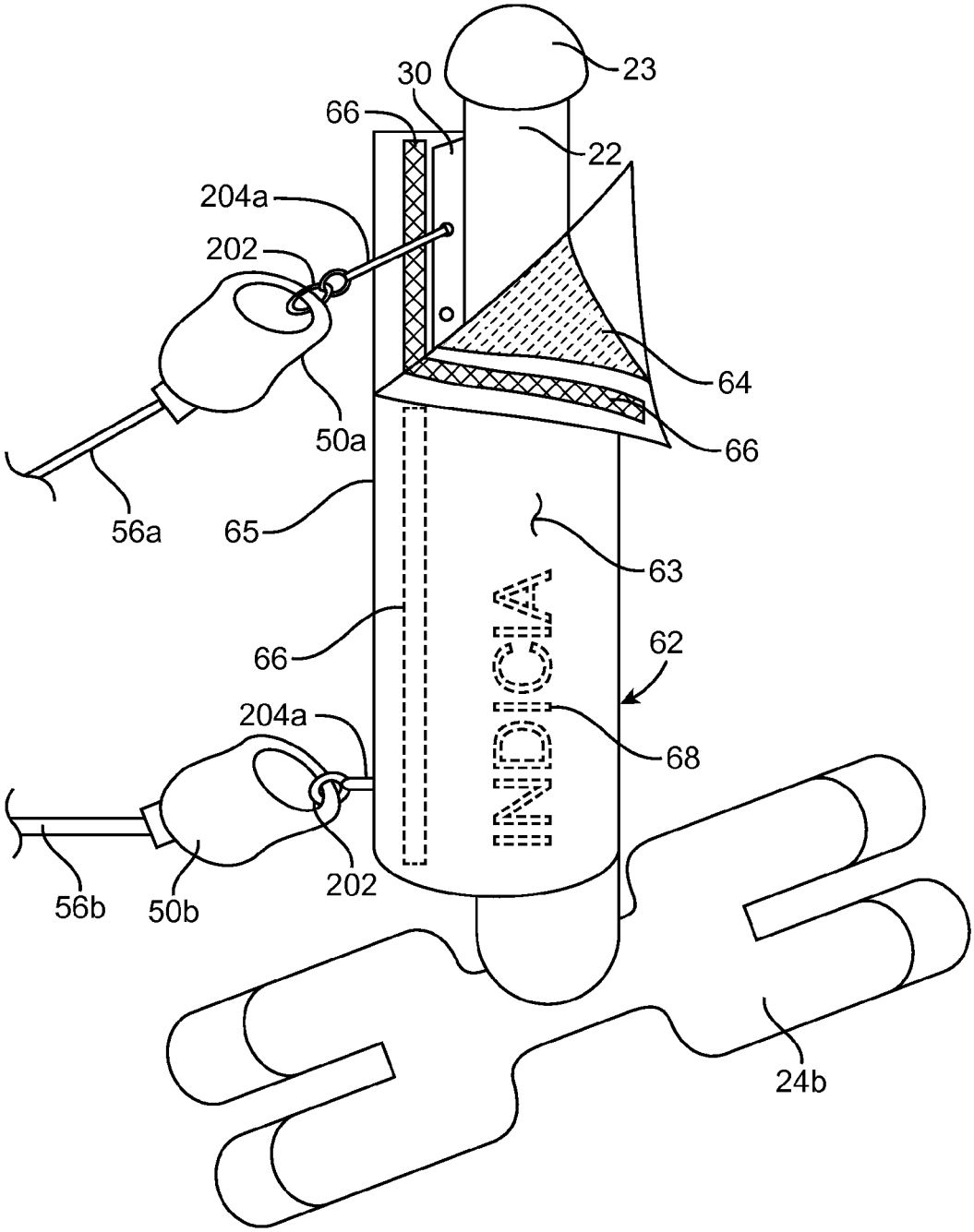
FIG. 5 is a close-up view of a cover assembly 62 used in the baseball strike zone training aid 10 shown in FIG. 1.
Figure 6:
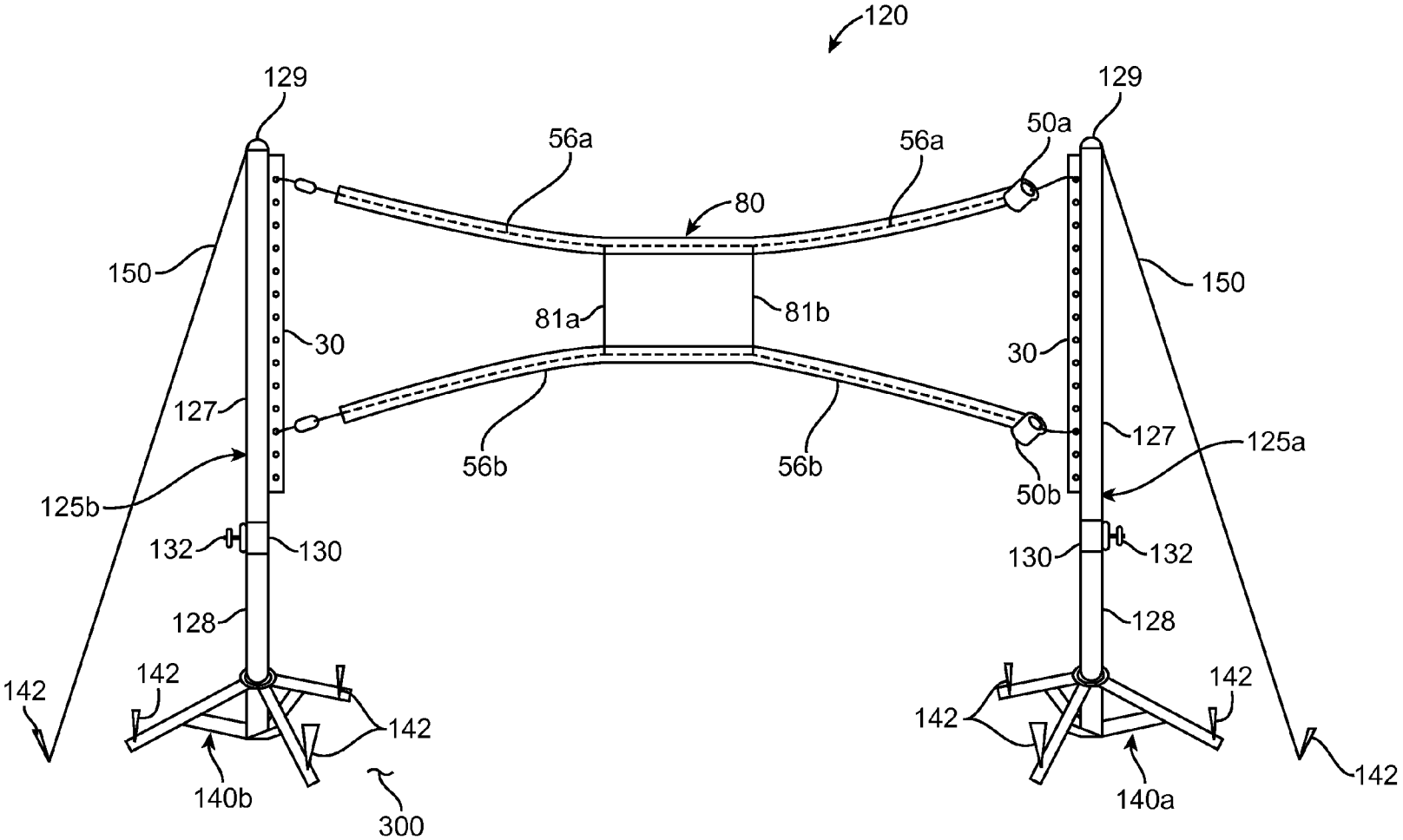
FIG. 6 is a front view of a personal strike zone training aid 120 that is in accord with the principles of the present invention; and, FIG. 7 is a front view of a permanent strike zone training aid 160 that is also in accord with the principles of the present invention.
Figure 7:
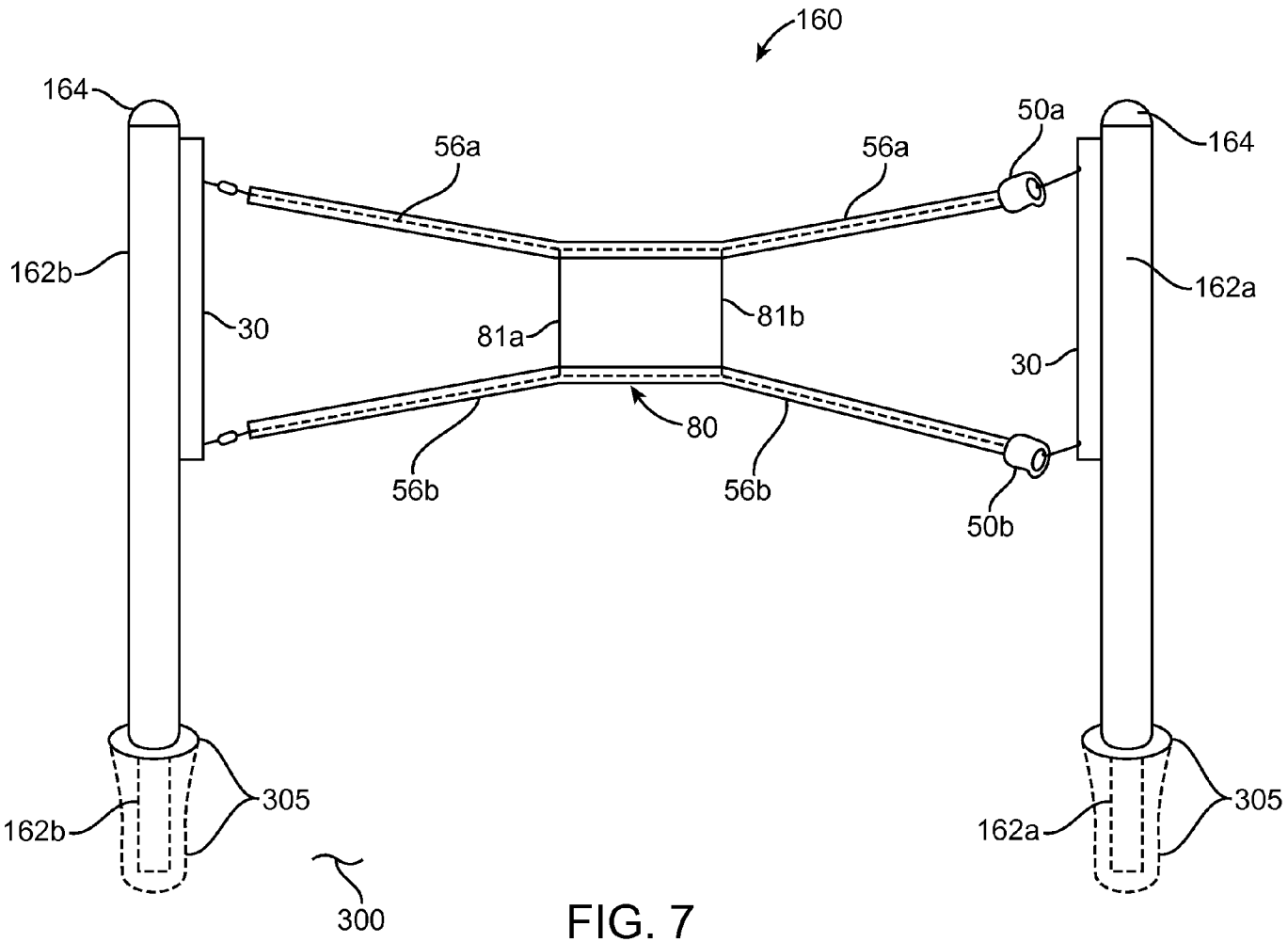

The best mode for carrying out the invention is presented in terms of its preferred embodiment, herein depicted in FIGS. 1 through 5, while alternative embodiments are shown in FIGS. 6 and 7. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The principles of the present invention provide for baseball training aids. In particular, a preferred embodiment of the present invention is a portable baseball strike zone training aid 10 that is useful for developing baseball hitting and pitching skills.

Refer now to FIG. 1, which is a front view of an in-use baseball strike zone training aid 10. The baseball strike zone training aid 10 includes a first post assembly 20*a* and a second post assembly 20*b* that are beneficially placed about fifteen feet (15 ft.) apart. The first post assembly 20*a* and the second post assembly 20*b* are used to support an upper horizontal cord 56*a*, a lower horizontal cord 56*b*, a first vertical cord 81*a*, and a second vertical cord 81*b* which collectively outline a strike zone 80.

Figure 2:
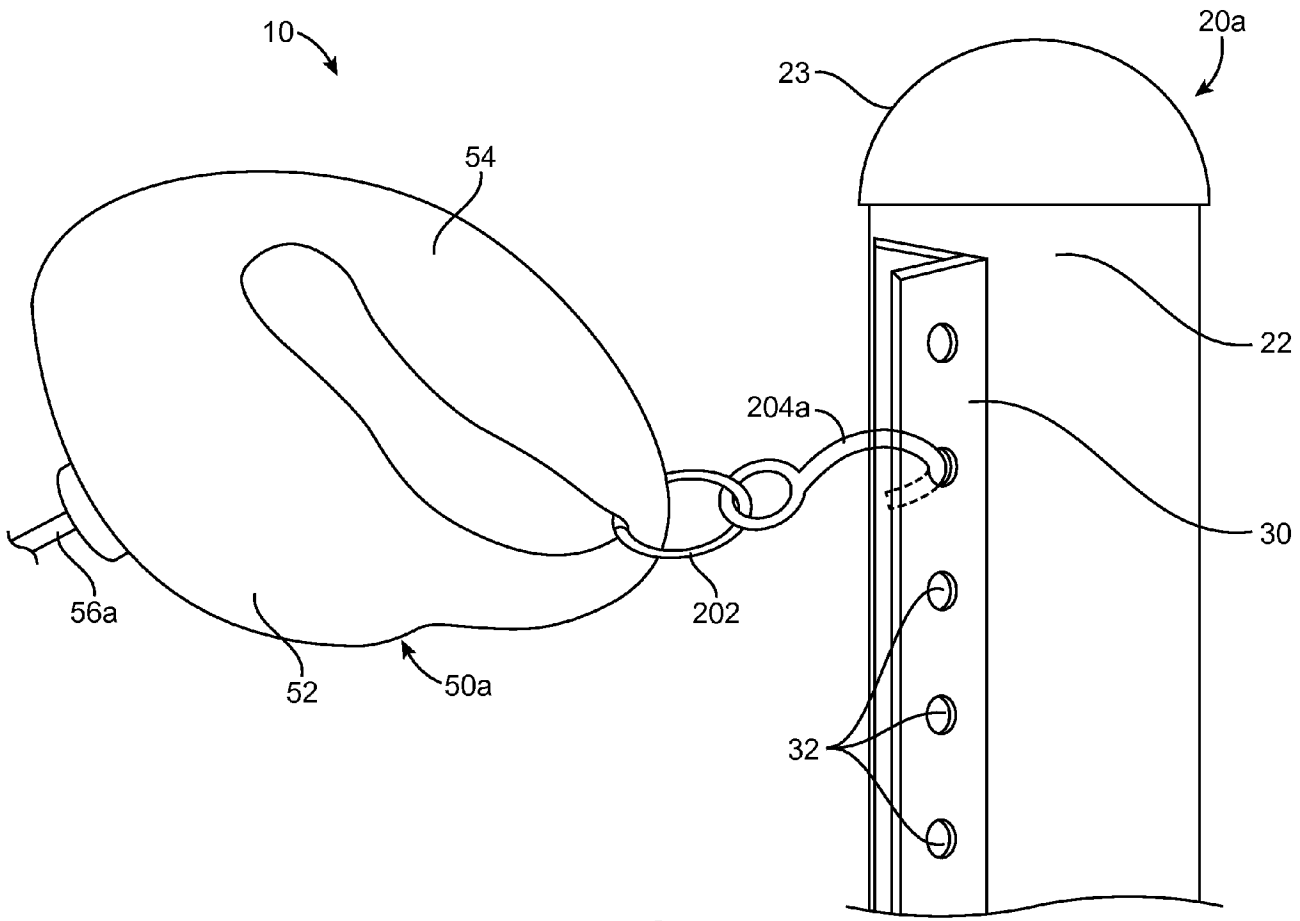
FIG. 2 is a close-up view of a first post assembly 20*a* used in the baseball strike zone training aid 10 shown in FIG. 1.

Referring now to FIGS. 1 and 2, each post assembly 20*a*, 20*b* is a unitary assembly comprising a first post 22*a*, 22*b*, a first cap 23, and a cord fastening angle member 30. The post assemblies 20*a*, 20*b* are preferably hollow tubular members made of three inch (3 in.) diameter polyvinyl chloride (PVC) pipe approximately four feet (4 ft.) high.

Figure 3:
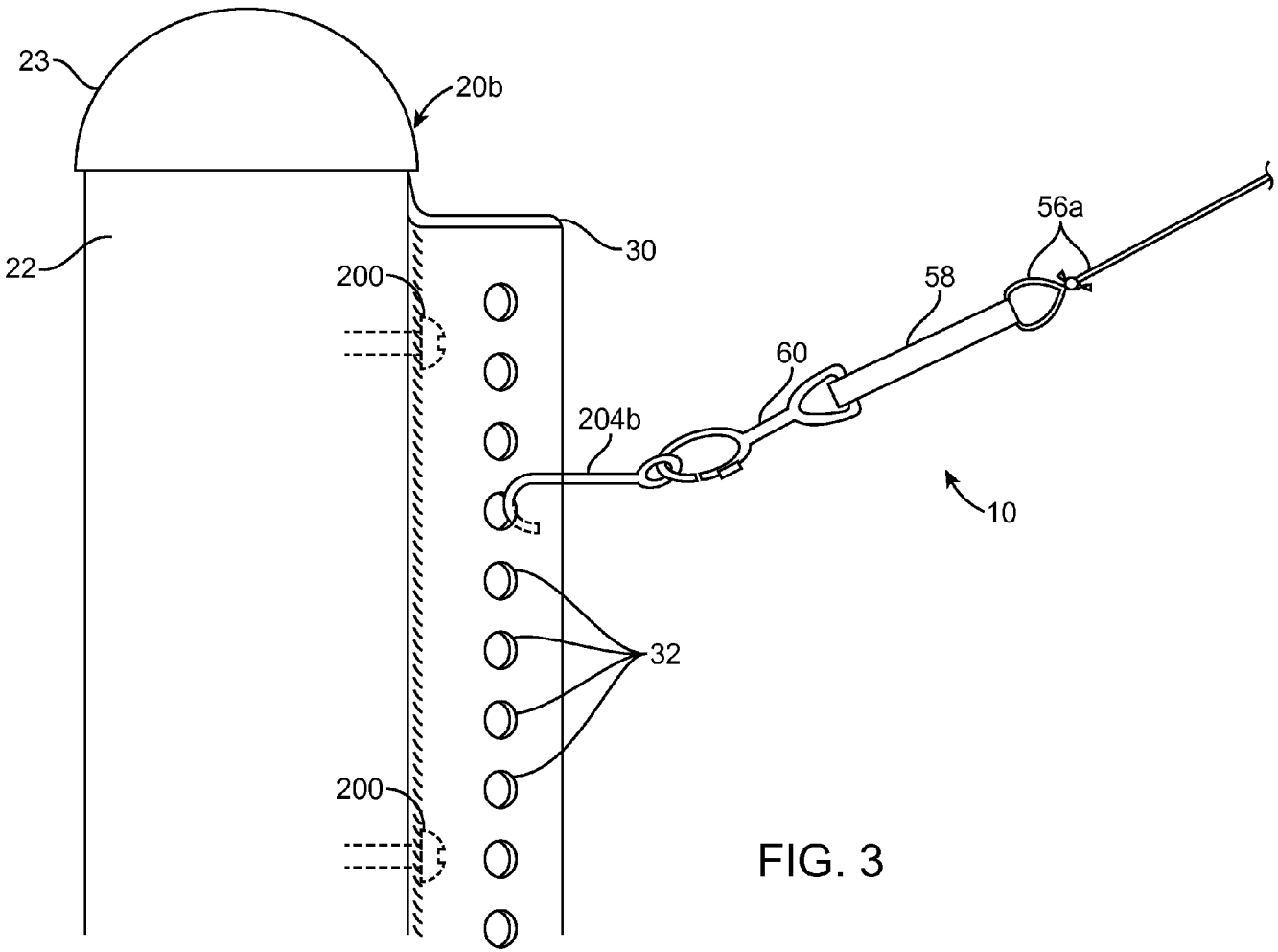
FIG. 3 is a close-up view of a second post assembly 20*b* used in the baseball strike zone training aid 10 shown in FIG. 1.

Each fastening angle member 30 comprises an angled plastic or metal strip that is attached to the first post 22*a* and the second post 22*b* using threaded fasteners 200 (see FIG. 3). Each fastening angle member 30 includes a vertical row of equally-spaced hook apertures 32 that are drilled or otherwise formed through the fastening angle member 30. The hook apertures 32 enable selective attachments of an upper first tensioner 50*a* and a lower second tensioner 50*b* on the first post assembly 20*a* and selective attachments of the upper horizontal cord 56*a* and the lower horizontal cord 56*b* on the second post assembly 20*b*.

The first tensioner 50*a* is used to tension the upper horizontal cords 56*a* while the lower second tensioner 50*b* is used to tension the lower horizontal cord 56*b*. Adjusting the tensions of the first tensioner 50*a* and the second tensioner 50*b* and their height positions on the fastening angle member 30 of the first post assembly 20*a*, and the height positions of the upper horizontal cord 56*a* and the lower horizontal cord 56*b* on the second post assembly 20*b* adjusts the position of the strike zone 80 (see also FIGS. 4 and 5). Once properly adjusted for a player 100 that player 100 and others can observe the flight of the ball 105 with regards to the strike zone 80.

Turning now to FIGS. 2 and 3 each tensioner 50*a*, 50*b* has a plastic body 52, an aperture-type handle 54, and an internal cord recoiling device which retains the tension up on the horizontal cords 56*a, b*. The first tensioner 50*a* is attached to an upper part of the fastening angle member 30 of the first post assembly 20*a* via a first hook 204*a* and a split ring 202 that surrounds the handle 54. The first hook 204*a* is inserted into a selected hook aperture 32. The upper horizontal cord 56*a* extends from the first tensioner 50*a* to the second post assembly 20*b* where it is attached at a similar height to the opposing fastening angle member 30 using a clasp 60 and a strap 58 with a second hook 204*b* (see FIG. 3). The second tensioner 50*b* and the horizontal cord 56*b* at the bottom are connected in the same manner to the first post assembly 20*a*).

Referring now to FIGS. 1 and 5, at the bottom of each post assembly 20*a*, 20*b* is a removable foundation 24. The foundations 24 are a horizontally oriented "H"-shaped structures made of the same PVC pipe materials as the first post 22*a* and the second post 22*b*. The foundation includes PVC caps 26 on each "H"-shaped end. Each foundation 24 also includes a vertical cylindrical receiver 25 that is sized to allow snug insertion of the ends of the first post 22*a* and second post 22*b*. Each foundation 24 is filled with a heavy fill material 28 (see FIG. 1) such as sand to stabilize the baseball strike zone training aid 10 on a surface 300 during use. The filler material 28 may be factory-installed or added by a through the receiver 25 as desired.

While the foregoing is described using hollow PVC materials, it should be understood that various equivalent materials such as, but not limited to: thin-wall steel or aluminum tubing, wooden posts, and the like, may be also used.

FIG. 4 presents a close-up view of the strike zone 80. The upper horizontal cord 56*a* and the lower horizontal cord 56*b* are to be arranged in a generally parallel manner. The horizontal cords 56*a*, 56*b* are pulled together using an adjustable first vertical cord 81*a* and an adjustable second vertical cord 81*b*. This configuration enables an adjustable rectangular strike zone 80. The first vertical cord 81*a* and the second vertical cord 81*b* are envisioned as being spaced apart the width of home plate. The vertical cords 81*a*, 81*b* have loops 82 at each end that surround a respective horizontal cord 56*a*, 56*b*. Each loop 82 is secured using a crimped ferrule 84. The lengths of the vertical cords 81*a*, 81*b* are envisioned as being proportional to a batting player's height and in accord with applicable game regulations. The loops 82 allow each vertical cord 81*a*, 81*b* to slide along the horizontal cords 56*a*, 56*b* to allow the strike zone 80 to be adjusted as desired.

It is envisioned that the horizontal cords 56*a*, 56*b* and vertical cords 81*a*, 81*b* may be made using various durable materials such as masonry string, light cord, plastic or rubber coated rope, and the like. For visibility those cords are preferably dyed or coated with various bright colors to increase the visibility of the strike zone 80 for the pitcher, batter, and coach.

FIG. 5 presents a close-up view of a cover assembly 62 of the baseball strike zone training aid 10. There is a cover assembly 62 on the first post 22*a* and on the second post 22*b*. The cover assemblies 62 are padded and are configured to be easily removed. The cover assemblies 62 provide protection from damage from impact by a ball 105 (see FIG. 1). Each cover assembly 62 has a plastic or vinyl outer jacket 63, and inner layer of padding 64, a detachable vertical seam 65, and a pair of mating hook-and-loop fastener strips 66. The padding 64 is beneficially polyurethane foam that is bonded to the inner surface of the jacket 63. The padding 64 is used to absorb the force of the ball 105. Furthermore, each cover assembly 62 is envisioned as having exterior indicia 68 which may include sports names/logos, advertising names and trademarks, personal names, symbols, pictures, various colors and patterns, and the like to customize and personalize the baseball strike zone training aid 10.

FIG. 6 presents a front view of a personal embodiment strike zone training aid 120 which is configured to support a higher strike zone 80 than the baseball strike zone training aid 10. A higher strike zone 80 enables the personal embodiment strike zone training aid 120 to be used with taller players 100. The personal embodiment strike zone training aid 120 uses the same tensioners 50*a*, 50*b*, horizontal cords 56*a*, 56*b* and vertical cords 81*a*, 81*b* as in the previously described baseball strike zone training aid 10. However, the personal embodiment strike zone training aid 120 uses a taller, tripod-mounted first post assembly 125*a* and a taller, tripod-mounted second post assembly 125*b* than the first post 22*a* and second post 22*b* of the baseball strike zone training aid 10.

Each post assembly 125*a*, 125*b* incorporates an assembly of tubular metal members including an upper second post 127 having a third cap 129 having a wire attachment feature, a lower third post 128 having an integral height adjustment sleeve 130, and a collapsible tripod base 140*a*, 140*b*.

Assembling the first tripod post assembly 125*a* and the second tripod post assembly 125*b* is accomplished by telescoping a second post 127 into the height adjustment sleeve 130 of a third post 128 and then securing the second post 127 and the third post together using a tightening knob 132. The third cap 129 is then attached to the second post 127 and the third post 128 is then inserted into an open top of a tripod base 140*a*, 140*b*.

Each tripod base 140*a*, 140*b* is envisioned as being similar to or identical with commercially-available collapsible-leg units used with T-ball tripod products such as the RAWLINGS QUICKTEE®. The tripod base 140*a*, 140*b* has collapsible expanding legs 141 having integral anchoring apertures that are suitable to receive stakes 142 which are driven into a subjacent floor/ground surface 300. Furthermore, if required, guy wires 150 can be connected to the top-mounted third cap 129 by using its attachment feature (such as an eyelet or bolt) and then securing the guy wire 150 to the floor/ground surface 300 using a stake 142. This provides secure, vertical mounting of the personal embodiment strike zone training aid 120.

FIG. 7 illustrates a front view of a permanent embodiment strike zone training aid 160 according to an alternate embodiment of the present invention. The permanent embodiment strike zone training aid 160 enables permanent installation onto a floor/ground surface 300. The permanent embodiment strike zone training aid 160 uses the same tensioners 50*a*, 50*b*, horizontal cords 56*a*, 56*b*, and vertical cords 81*a*, 81*b* as in the baseball strike zone training aid 10. However, the permanent embodiment strike zone training aid 160 uses a first permanent post assembly 162*a* and a second permanent post assembly 162*b*, each of which has a fastening angle member 30 and a fourth cap 164. The first permanent post assembly 162*a* and the second permanent post assembly 162*b* are envisioned as being made from PVC or metal pipe having a bottom end that is configured to be inserted into an excavated region of the floor/ground surface 300 and then permanently secured in position by burying or by using concrete footers 305.

It is envisioned that other styles and configurations of the present invention can be easily incorporated into the teachings of the present invention, and only one particular configuration shall be shown and described for purposes of clarity and disclosure and not by way of limitation of scope.

The preferred embodiment baseball strike zone training aid 10 can be used by the common user in a simple and effortless manner with little or no training. After initial purchase or acquisition of the baseball strike zone training aid 10 it would be installed and used as indicated in FIG. 1.

The method of installing and using the baseball strike zone training aid 10 may be achieved by performing the following steps: procuring the baseball strike zone training aid 10 having cover assemblies 62 which display a desired indicia 68; positioning the first 24*a* and second 24*b* foundations on a floor/ground surface 300 at a desired distance from each other; attaching the first post 22*a* and the second post 22*b* to corresponding foundations 24*a*, 24*b* by inserting the receivers 25 of the foundations 24 into the open bottom ends of the posts 22*a*, 22*b*; attaching the first hook 204*a* of the first tensioner 50*a* to a desired hook aperture 32 located near the top of the first post assembly 20*a* to position the strike zone 80 at a desired height; pre-assembling the second hook 204*b* to the clasp 60 of the upper horizontal cord 56*a*; connecting the upper horizontal cord 56*a* to the first tensioner 50*a*; extending the horizontal cord 56*a*; attaching the second hook 204*b* to a hook aperture 32 of the second post assembly 20*b* at a corresponding height; installing the second tensioner 50*b* to the lower horizontal cord 56*b* in like manner to a lower part of the first post assembly 20*a* and second post 20*b*; installing cover assemblies 62 onto the first post assembly 20*a* and second post assembly 20*b* by wrapping a jacket 63 around each post assembly 20*a*, 20*b*; aligning the seam 65 with the protruding first hook 204*a*; joining the seam 65 by pressing the hook-and-loop fasteners 66 together; adjusting the vertical cords 81*a*, 81*b* in a lateral direction, as needed to produce a strike zone 80 having a desired width; using the baseball strike zone training aid 10 to practice hitting and/or pitching; and, benefiting from an easily assembled and adjustable training aid afforded a user of the present invention 10.

The method of installing and using the personal embodiment strike zone training aid 120 may be achieved by performing the following steps: positioning the first 140*a* and second 140*b* tripod bases upon a floor/ground surface 300 at a desired distance from each other; anchoring the tripod bases 140*a*, 140*b* by driving stakes 142 through the apertures of the tripod bases 140*a*, 140*b* and into the floor/ground surface 300; assembling the first tripod post assembly 125*a* and second tripod post assembly 125*b* to the tripod bases 140*a*, 140*b* by inserting a preassembled second post 127 and third post 128 into a tripod base 140*a*, 140*b*; adjusting the height of the second posts 127 using the height adjustment sleeve 130 and corresponding tightening knob 132; installing guy wires 150, if desired, by tying the guy wires 150 to third cap 129 atop the first 125*a* and second 125*b* tripod post assemblies and securing the guy wires to the floor/ground surface 300 using additional stakes 142; attaching the tensioners 50*a*, 50*b* and horizontal cords 56*a*, 56*b* in like manner as the personal embodiment strike zone training aid 10 described above; and, using the enhanced vertical adjustment capability of the personal embodiment strike zone training aid 120 for players 100.

The method of installing and utilizing the permanent embodiment strike zone training aid 160 may be achieved by performing the following steps: selecting desired positions along a floor/ground surface 300 for installation of the first 162*a* and second 162*b* permanent post assemblies; performing necessary excavation of the floor/ground surface 300 to bury the ends of the permanent post assemblies 162*a*, 162*b*; backfilling or adding concrete footers 305, as desired, to anchor the permanent post assemblies 162*a*, 162*b* into the floor/ground surface 300; attaching the tensioners 50*a*, 50*b*, horizontal cords 56*a*, 56*b*, and vertical cords 81*a*, 81*b* to the vertical posts (162*a* and 162*b*) as in the baseball strike zone training aid 10 described above; and, utilizing the permanent embodiment strike zone training aid 160 in a similar manner as the preferred baseball strike zone training aid 10.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A baseball strike zone training aid, comprising:

a first post assembly having a first upper attachment feature and a first lower attachment feature;

a second post assembly having a second upper attachment feature and a second lower attachment feature;

an upper horizontal cord suspended between said first upper attachment feature and said second upper attachment feature;

a lower horizontal cord suspended between said first lower attachment feature and said second lower attachment feature;

a vertically orientated and elongated fastening angle member having a plurality of hook apertures attached to said first post assembly;

a first vertical cord disposed between said upper horizontal cord and said lower horizontal cord; and, a second vertical cord disposed between said upper horizontal cord and said lower horizontal cord;

wherein said upper horizontal cord, said lower horizontal cord, said first vertical cord, and said second vertical cord define a strike zone.

2. The baseball strike zone training aid according to claim 1, wherein said first upper attachment feature includes a first tensioner operatively connected to an upper hook aperture of said plurality of hook apertures, and wherein said first lower attachment feature includes a second tensioner operatively connected to a lower hook aperture of said plurality of said hook apertures, wherein said first tensioner tensions said upper horizontal cord and wherein said second tensioner tensions said lower horizontal cord.

3. The baseball strike zone training aid according to claim 2, wherein the height of said strike zone depends on said upper hook aperture, said lower hook aperture, tension applied by said first tensioner, and tension applied by said second tensioner.

4. The baseball strike zone training aid according to claim 3, wherein said first tensioner is connected to said upper hook aperture by a first hook and a split ring.

5. The baseball strike zone training aid according to claim 3, wherein said upper horizontal cord is connected to said second post assembly by a clasp, a strap, and a second hook.

6. The baseball strike zone training aid according to claim 1, wherein said first vertical cord includes a first loop around said upper horizontal cord and a second loop around said lower horizontal cord, wherein said first loop is secured using a crimped ferrule.

7. The baseball strike zone training aid according to claim 2, further including a first "H"-shaped foundation attached to the bottom of said first post assembly and a second "H"-shaped foundation attached to the bottom of said second post assembly, wherein said first "H"-shaped foundation and said second "H"-shaped foundation vertically support said baseball strike zone training aid.

8. The baseball strike zone training aid according to claim 7, wherein said first "H"-shaped foundation includes a fill material.

9. The baseball strike zone training aid according to claim 8, wherein said fill material is sand.

10. The baseball strike zone training aid according to claim 1, further including a removable padded cover assembly on said first post assembly.

11. The baseball strike zone training aid according to claim 1, wherein said first post assembly and said second post assembly are configured to be buried.

12. A baseball strike zone training aid, comprising:

a first post assembly comprised of a first upper post, a wire attachment feature connected to said first upper post, a first lower post connected to said first upper post, a vertically orientated and elongated fastening angle member having a plurality of hook apertures, and a first tripod base attached to said first lower post;

a second post assembly comprised of a second upper post, a second lower post connected to said second upper post, and a second tripod base attached to said second lower post;

an upper horizontal cord suspended between said first post assembly and said second post assembly;

a lower horizontal cord suspended between said first post assembly and said second post assembly;

a first vertical cord disposed between said upper horizontal cord and said lower horizontal cord; and, a second vertical cord disposed between said upper horizontal cord and said lower horizontal cord;

wherein said upper horizontal cord, said lower horizontal cord, said first vertical cord, and said second vertical cord define a strike zone.

13. A baseball strike zone training aid according to claim 12, wherein said first tripod base is collapsible.

14. A baseball strike zone training aid according to claim 13, wherein said first lower post includes a height adjustment sleeve for attaching said first upper post to said first lower post and for adjusting the height of said first post assembly.

15. A baseball strike zone training aid according to claim 12, wherein said first tripod base includes a stake aperture.

16. A baseball strike zone training aid according to claim 15, further including a guy wire attached to said wire attachment feature.

17. The baseball strike zone training aid according to claim 12, wherein said attachment feature includes a first tensioner operatively connected to an upper hook aperture of said plurality of hook apertures, and wherein a first lower attachment feature includes a second tensioner operatively connected to a lower hook aperture of said plurality of said hook apertures, wherein said first tensioner tensions said upper horizontal cord and wherein said second tensioner tensions said lower horizontal cord.

18. The baseball strike zone training aid according to claim 17, wherein the height of said strike zone depends on said upper hook aperture, said lower hook aperture, tension applied by said first tensioner, and tension applied by said second tensioner.

* * * * *